United States Patent [19]

Leong

[11] Patent Number: 4,889,570

[45] Date of Patent: Dec. 26, 1989

[54] BLASTING EXPLOSIVE WITH IMPROVED WATER RESISTANCE

[75] Inventor: Dennis Y. Leong, Vancouver, Canada

[73] Assignee: ETI Explosives Technologies International (Canada), Ltd., Mississauga, Canada

[21] Appl. No.: 327,842

[22] Filed: Mar. 23, 1989

[51] Int. Cl.[4] ..... C06G 45/34

[52] U.S. Cl. ..... 149/7; 149/46; 149/60; 149/109.6

[58] Field of Search ..... 149/7, 46, 60, 109.6

[56] References Cited

U.S. PATENT DOCUMENTS 4,474,629 10/1984 York et al. ..... 149/46

4,475,965 10/1984 York et al. ..... 149/46

4,764,230 8/1988 Bates et al. ..... 149/109.6

*Primary Examiner*—Stephen J. Lechert, Jr.

*Attorney, Agent, or Firm*—Rogers, Bereskin & Parr

[57] ABSTRACT

A blasting explosive having improved water resistance comprises a particulate blend of from about 5 to about 27 wt. % of a slurry explosive and from about 73 to about 95 wt. % of a mixture of ammonium nitrate particles and a liquid hydrocarbon fuel based on the weight of the slurry, the ammonium nitrate particles and the fuel. The mixture of ammonium nitrate particles and a liquid hydrocarbon fuel contain from about 3.0 to about 6.0 wt. % hydrocarbon fuel based on the weight of the ammonium nitrate/fuel mixture. The blend is first coated with a gelling agent and subsequently coated with an anticaking agent.

26 Claims, No Drawings

BLASTING EXPLOSIVE WITH IMPROVED WATER RESISTANCE

FIELD OF THE INVENTION

The present invention relates to blasting explosives which comprise blends of ANFO (prilled Ammonium Nitrate/Fuel Oil mixtures) and a slurry explosive. More particularly, this invention relates to explosive blends which have improved water resistance.

BACKGROUND OF THE INVENTION

Blends of ANFO and slurry explosives are known and have been used commercially for about 15 years. Such blends contained up to about 50 wt. % ANFO in the blend and were suitable for use in large diameter boreholes, e.g. about 20 cm in diameter or greater. In recent years it has been found that higher percentages of ANFO in the blend could be used, e.g. up to about 85–90 wt. % ANFO. While blends with about 80–90 wt. % ANFO tend to have greater blasting power than the earlier blends of ANFO, they tend to have similar physical characteristics to ANFO, e.g. they retain the dry flowable characteristics, and retain the characteristic of being relatively easily desensitized by water. Such desensitization may occur as a result of attack by water when the explosive is in the borehole, or it may occur over a period of time because of migration of water from the slurry portion of the blend to the ANFO portion. Lack of water resistance or lack of "shelf stability" of the blend may lead to poor blasting characteristics. Methods for "waterproofing" ammonium nitrate or ANFO have been disclosed in a number of publications.

U.S. Pat. No. 2,537,039 relates to gelatinous compositions, e.g. ammonia dynamites, with various tackifying agents. A)so disclosed are certain non-nitroglycerin gelatinous explosives, including one comprising 97.0% ammonium nitrate and 3.0% of a non-explosive gel, containing 95% petrolatum and 5% polyisobutylene having a molecular weight of 80,000.

U.S. Pat. No. 3,160,536 relates to explosive mixtures of granular ammonium nitrate, a liquid hydrocarbon and a metallic soap. The hydrocarbon and metallic soap form a substance having a gel-like consistency with which to coat the ammonium nitrate, thus rendering the mixture hydrophobic and permitting packaging in a water-impervious flexible plastic container.

U.S. Pat. No. 3,287,189 relates to grease-coated porous, particulate ammonium nitrate explosive compositions which are formed by dusting or otherwise blending particulate porous ammonium nitrate, for example prilled or ground ammonium nitrate, with from about 0.5 to about 2 wt. % of a finely divided alkali or alkaline earth metal salt of an aliphatic carboxylic acid of 8 to 24 carbon atoms. The grease-coated ammonium nitrate may then be mixed with fuel oil to form an explosive composition. Alternatively, the ANFO may be mixed with an aqueous ammonium nitrate solution containing a thickening agent, e.g. guar gum, to provide an aqueous slurry explosive containing from 3 to 15 wt. % water. Part of the ammonium nitrate is first mixed with a grease composition and a selected hydrocarbon fuel oil prior to being added to the aqueous solution. Such slurry explosives are characterized as ranging from a pourable slurry to a thick paste to provide a protective water-resistance grease coating in the pores of, and on the particles of, the ammonium nitrate.

U.S. Pat. No. 3,919,016 discloses a process for thickening hydrocarbon oil slurries of ammonium nitrate with a latex of an elastomer which is inverted into the nitrate slurry. One of the latices disclosed contains from about 5 to 75 wt. % cis-1,4-polyisoprene and polyisobutylene, 25 to 75 wt. % water and 0.01 to 5 wt. % water-soluble surfactant.

U.S. Pat. No. 4,278,480 relates to slurry explosives which are permanently tacky and which may be adhesively applied to surfaces to be blasted. Particulate ammonium nitrate is mixed with a polymer comprising a pourable isobutylene, which is semi-solid but fluent at room temperature. The explosives exemplified include polyisobutylene at concentrations of from 20 to 25 wt. % .

SUMMARY OF THE INVENTION

A method has now been found to improve the water resistance of blends of (a) a slurry explosive and (b) ANFO or like mixtures.

Accordingly, the present invention provides a blasting explosive comprising a particulate blend of from about 5 to about 27 wt. % of a slurry explosive and from about 73 to about 95 wt. % of a mixture of ammonium nitrate particles and a liquid hydrocarbon fuel based on the weight of the slurry and the ammonium nitrate/fuel mixture, the mixture of ammonium nitrate particles and a liquid hydrocarbon fuel containing from about 3.0 to about 6.0 wt. % hydrocarbon fuel based on the weight of the ammonium nitrate/fuel mixture, said particles of said blend being coated first with a gelling agent, and then coated with an anticacking agent.

In another embodiment the hydrocarbon fuel is selected from the group consisting of fuel oil, diesel fuel and mineral oil.

In yet another embodiment the gelling agent is a cold water hydrating guar gum.

In another embodiment the gelling agent is present in an amount of from 2.5 to 5.0 wt. % of the blend.

In a further embodiment the ammonium nitrate portion of the ammonium nitrate/liquid hydrocarbon consists of particulate, porous ammonium nitrate.

In yet another embodiment the anticaking agent is selected from the group consisting of amorphous silica, fumed silica and silicates.

In another embodiment the anticaking agent is present in an amount of from 1.0 to 4.0 wt. % of the blend.

SPECIFICATION OF THE PREFERRED EMBODIMENT

The ammonium nitrate (AN) particles are preferably in the form of porous prills. The AN or ANFO prills used should be of the kind which are normally effective when used alone as a blasting agent. The particle size of the prills is preferably between 6 and 20 TYLER* sieve size. Typically, such prills have a particle density of 1.35 g/cc to 1.52 g/cc, a prill void volume of 10.0 to 18.5% and a poured density of 0.70 g/cc to 0.85 g/cc, preferably from 0.76 to 0.80 g/cc. In the trade such porous prills are known as prilled AN, and are distinguished from high density prills. The porous prills may also contain anticaking agents, as is known in the art.

*denotes trade mark

The liquid hydrocarbon fuel may be selected from any such fuel known in. the art. Exemplary are fuel oil, heating oil, diesel fuel, jet fuel, kerosene, mineral oils, saturated fatty acids, e.g. lauric acid and stearic acid, alcohols, e.g. cetyl alcohol, corn oil, soybean oil and the like. Such fuels may be supplemented with fuel-soluble ingredients such as glucose, mannose, fructose, waxes, e.g. microcrystalline wax, paraffin wax, petrolatum wax and the like.

The liquid hydrocarbon fuel is present in the ammonium nitrate/fuel mixture in a concentration of from about 3.0 to about 6.0 wt. % and, preferably from about 4.0 to about 5.0 wt. % of the mixture.

The gelling agent is preferably present in an amount from about 2.5 to about 5.0 wt. % of the blend. The gelling agent may be a guar gum and, preferably, a cold water hydrating guar gum.

It is advantageous that the anticaking agent be present in an amount from about 1.0 to about 4.0 wt. % of the blend, and preferably, from about 1.5 to about 3.0 wt. % . The anticaking agent is selected from the group consisting of amorphous silica, fumed silica and silicates. The anticaking (or moisture protection agent) may be a finely divided amorphous silica, for example SYLOX 2*, fine particle size silicate, for example VERMICULITE #7* or of like ingredients.

*denotes trade mark

The slurry explosive portion of the blasting explosive is of conventional composition. For example, suitable slurry explosives may contain from 5 to 25 wt. % water and may be sensitized with a water-soluble sensitizer, e.g. monomethylammonium nitrate. Examples of suitable slurry explosives may be found in Canadian patent No. 899,072 to Dunglinson and Lyerly.

The blasting explosive may be prepared by first mixing the liquid hydrocarbon fuel with the particulate ammonium nitrate in the manner known in the art. For example, fuel oil may be injected into an auger through which prilled porous ammonium nitrate is being transported. The thus-formed mixture may then be directly augered into a blender in which a slurry explosive has been made. Alternatively, the ammonium nitrate/fuel mixture may be pre-made and stored prior to blending with the slurry explosive. The weight ratio of slurry explosive to ammonium nitrate/fuel mixture is in the range from 5:95 to 27:73, preferably from 7:93 to 15:85 based on the weight of the slurry and the ammonium nitrate/fuel mixture. The gelling agent, for example cold water hydrating guar gum is then added to the blend, in order to coat the particles with the gelling agent. In the final step, the anticaking agent or moisture protection agent is added to the gelling agent-coated blend.

The physical characteristics of the blasting explosives so formed depend upon a number of factors, including the ratio of slurry explosive to ammonium nitrate/fuel mixture, the particle size of the ammonium nitrate, and the water content of the slurry explosive.

The invention is illustrated by reference to the following examples:

EXAMPLE 1

An ANFO mixture was prepared by mixing 491 g of #2 fuel oil with 9253 g of prilled ammonium nitrate. The prilled ammonium nitrate had a particle size distribution of between 6 and 20 TYLER mesh and a poured density of 0.78 g/cc. The ANFO mixture had a poured density of 0.83 g/cc.

40 kg of a slurry explosive was prepared in a ribbon blender from 6.8 kg ammonium nitrate, 13.68 kg sodium nitrate, 14.03 kg monomethylamine nitrate dissolved in 3.73 kg water, 240 g NGL-2203* guar gum, 440 g GALACTOSOL 245D* guar gum, 800 g ethylene glycol, 280 g expanded perlite, and 6.16 g fumaric acid. The monomethylamine nitrate, water, ethylene glycol, and fumaric acid were added to the blender and thoroughly mixed. The NGL-2203 and GALACTOSOL 245D guar gums were dry blended with 6.4 kg of the sodium nitrate and then added to the mixture in the blender. Blending was continued until the guar gums had hydrated. Then the perlite and the ammonium nitrate were added and the remaining sodium nitrate was finally added. The density of the slurry explosive so formed was 1.23 g/cc.

1630 g of the slurry explosive and the ammonium nitrate/fuel mixture were blended in a cement mixer. 350 g of a cold hydrating guar gum, NGL-2280* were added to the blend and mixed thoroughly until the particles were coated with the guar gum. Finally, 350 g of SYLOX 2 amorphous silica were added to the blend and the whole was thoroughly mixed. The resulting blasting explosive was similar in physical characteristics to prior-art ANFO, e.g. it was free flowing. However, the blasting explosive prepared in this Example was less prone to lumping caused by the premature hydration of the gelling agent when the explosive was stored for substantial lengths of time.

*denotes trade mark

EXAMPLE II

An ANFO mixture was prepared by mixing 370 g of #2 fuel oil with 8460 g of prilled ammonium nitrate having a particle size distribution of between 6 and 20 TYLER mesh and a poured density of 0.78 g/cc.

40 kg of a slurry explosive was prepared in a ribbon blender from 9720 g sodium nitrate, 23542 g monomethyamine nitrate dissolved in 6258 g water, 480 g GALACTOSOL 510* guar gum, and 3.0 g of fumaric acid. The monomethylamine nitrate, water, and fumaric acid were added to the blender and thoroughly mixed. Next 5720 g of sodium nitrate were added and blending was continued to dissolve some sodium nitrate and lower the liquor temperature. 480 g of the guar gum were dry blended with 4000 g of sodium nitrate and these were added to the blender as the final step. The density of the slurry explosive so formed was 1.35 g/cc.

700 g of the slurry explosive and the ammonium nitrate/fuel mixture were blended in a cement mixer. 350 g of a cold hydrating guar gum, NGL-2280* were added to the blend and mixed thoroughly until the particles were coated with guar gum. Finally, 120 g of SYLOX 2* anticaking agent were added to the blend and the whole thoroughly mixed. The resulting blasting explosive was similar in physical characteristics to prior-art ANFO, e.g. it was free flowing. However, the resulting blasting explosive was less prone to lumping when stored for substantial lengths of time.

*denotes trade mark

The blend was packaged in a 4 ply-poly bag (25 kg capacity) and stored at ambient conditions (20° C.±5° C.) The blend was loaded pneumatically into a 1.5" diameter schedule 40 mild steel pipe, 165 cm long with a 50-kg-capacity Teledyne ANFO loader at an air pressure of 420 kPa through a 15 meter loading hose having a 1.9 cm inner diameter. The loader had a tank with a conical bottom having a 45° conical angle. The blend was initiated with a No. 12 electric blasting cap. The loaded densities and detonation velocities are listed below.

| Blend Age (days) | Density (g/cc) | V.O.D. (m/s) |
|---|---|---|
| as made | 0.95 | 3631 |
| 40 | 0.98 | 3578 |
| 69 | 0.95 | 3735 |
| 92 | 0.92 | 3215 |

The blended product was also 1 loaded in a 2.0" diameter sch. 40 mild steel pipe, 61 cm long. The pipe was filled halfway with the blend. The blend inside the pipe was gently tapped 3 times with a plastic rod. The pipe was then filled with the blend 4" from the top where a ⅓ lb primer was inserted. The blended product was used to fill the empty spaces between the primer and the pipe. The blend as initiated with the ⅓ lb primer. The loaded densities and detonation velocities are shown below.

| Blend Age (days) | Density (g/cc) | V.O.D. (m/s) |
|---|---|---|
| as made | 0.82 | 3030 |
| 37 | 0.81 | 3030 |
| 63 | 0.90 | 2871 |
| 79 | 0.93 | 3640 |
| 93 | 0.91 | 3023 |

EXAMPLE III 700 g of the slurry explosive and the ammonium nitrate/fuel mixture in Example II were blended in a cement mixer. 350 g of a cold hydrating guar gum, NGL-2280* were added to the blend and mixed thoroughly until the particles were coated with guar gum. Finally, 150 g of VERMICULITE #7* were added to the blend and the whole thoroughly mixed. The resulting blasting explosive was similar in physical characteristics to prior-art ANFO, e.g. it was free flowing. However, the resulting blasting explosive was less prone to lumping when stored for substantial lengths of time.
*denotes trade mark The blend was packaged in a 4 ply-poly bag (25 kg capacity) and stored at ambient conditions (20° C.±5° C.). The blend was loaded pneumatically into a 1.5" diameter schedule 40 mild steel pipe, 165 cm long with a 50-kg-capacity Teledyne ANFO loader at an air pressure of 420 kPa through a 15 meter loading hose having a 1.9 cm inner diameter. The
*denotes trade mark loader had a tank with a conical bottom having a 45° conical angle. The blend was initiated with a No. 12 electric blasting cap. The loaded densities and detonation velocities are listed below.

| Blend Age (days) | Density (g/cc) | V.O.D. (m/s) |
|---|---|---|
| 2 | 0.97 | 3256 |
| 35 | 0.97 | 3341 |
| 91 | 1.04 | 3256 |

EXAMPLE IV 1094 g of #2 Fuel Oil were mixed with 20781 g. of prilled ammonium nitrate having a particle size distribution of between 6 and 20 Tyler mesh and a poured density of 0.78 g/cc. The ANFO mixture had a poured density of 0.83 g/cc.

1545 kg. of a slurry explosive were prepared in a mixing vessel from 409.55 kg. ammoniun nitrate, 224.55 kg. sodium nitrate, 627.8 kg. monomethylamine nitrate dissolved in 232.2 kg. water, 10.96 kg. glass bubbles (B-28-750). 8.96 kg. of polyacrylamide (PERCOL*, 155), 4.56 kg. of propylene glycol (PPG 425), 3.09 kg. of (NGL-4923) guar gum, 0.245 kg. of DW3-CA, 3.79 kg. of TYZOR LA* (undiluted) and 18.86 kg. of water used to dilute the TYZOR LA and 0.435 kg. of fumaric acid.
*denotes trade mark An aqueous solution (liquor) of about 73% by weight of monomethylamine nitrate (MMAN), at a temperature of 80° C. was added to the blender. The pH of the hot liquor was adjusted to approximately 4.3. Propylene glycol and 386.38 kg. of ammonium nitrate were added to the blender and thoroughly mixed. Next 10.96 kg. of glass bubbles were added to the blender and mixed. Next 218.18 kg. of sodium nitrate, 3.09 kg. of (NGL-4923) guar gum, 8.96 kg. polyacrylamide (PERCOL, 155) and 0.435 kg. of fumaric acid are added to the blender and mixed thoroughly. The remaining ammonium nitrate and sodium nitrate were added and thoroughly mixed. The DW3-CA, TYZOR LA and remaining water used to dilute the TYZOR LA was added to the blend and mixed. The density of the slurry explosive so formed was 1.35 g./cc.

2,000 g. of the slurry explosive and the ammonium nitrate/fuel oil mixture were blended in a cement mixer. 750 g. of a cold hydrating guar gum (NGL-2280)* were added to the blend and mixed thoroughly until the particles were uniformly coated with the guar gum.
*denotes trade mark Finally, 400 g. of SYLOX 2 anticaking agent were added to the blend and thoroughly mixed. The resulting blasting explosive was similar in physical characteristics to prior-art ANFO, e.g. it was free flowing. However, the resulting blasting explosive was less prone to lumping when stored for substantial lengths of time.

The blend was packaged in a 4 ply-poly bag (25 kg capacity) and stored at ambient conditions (20° C.±5° C.) The blend was loaded pneumatically into a 1.5" diameter schedule 40 mild steel pipe, 165 cm long with a 50-kg-capacity Teledyne ANFO loader at an air pressure of 420 kPa through a 15 meter loading hose having a 1.9 cm inner diameter. The loader had a tank with a conical bottom having a 45° conical angle. The blend was initiated with a UA-4+No. 12 electric blasting cap. The loaded densities and detonation velocities are listed below.

| Blend Age (days) | Density (g/cc) | V.O.D. (m/s) |
|---|---|---|
| as made | 0.94 | 3174 |
| 14 | 0.96 | 3174 |
| 29 | 0.97 | 3256 |

EXAMPLE V

An ANFO mixture was prepared by mixing 1500 g of #2 fuel oil with 23500 g of prilled ammonium nitrate having a particle size distribution of between 6 and 20 Tyler mesh and a poured density of 0.78 g/cc.

The ANFO was packaged in a 4-ply poly bag (25 kg capacity) and stored at ambient conditions (20° C.±5° C.) The ANFO was loaded pneumatically into a 1.5" diameter schedule 40 mild steel pipe, 165 cm long with a 50-kg capacity Teledyne loader at an air pressure of 420 kPa through a 15 meter loading hose having 1.9 cm inner diameter. The loader had a tank with a conical bottom having a 45° conical angle. Approximately 122 cm of pipe was filled with ANFO. The pneumatically loaded density of the ANFO was 0.94 g/cc. The pipe was then placed in the upright (vertical-90°) position. Tap water was poured into the open end at the top of the pipe at a rate of 29 ml/sec. A total of 650 ml of water was used. The bottom of the pipe was placed in a 1000 ml plastic beaker and left to stand in the upright position for 26 hrs. The ANFO in the pipe was then initiated with a UA-4+No. 12 electric blasting cap. The ANFO failed to detonate, hence no V.O.D. was recorded.

A blend like the one in Example 1 was loaded pneumatically into a 1.5" diameter schedule 40 mild steel pipe, 165 cm long with a 50-kg capacity Teledyne loader at an air pressure of 420 kPa through a 15 meter loading hose having a 1.9 cm inner diameter. The loader had a tank with a conical bottom having a 45° conical angle. Approximately 122 cm of pipe was filled with the blend. The pneumatically loaded density of the blend was 0.95 g/cc. The pipe was then placed in the upright (vertical-90°) position. Tap water was poured into the open end at the top of the pipe at a rate of 30 ml/sec. A total of 650 ml of water was used. The bottom of the pipe was placed in a 1000 ml plastic beaker and left to stand in the upright position for 26 hrs. The blend in the pipe was then initiated with a UA-4+No. 12 electric blasting cap. The blend was initiated and the following V.O.D. was recorded: 3256 m/s.

I claim:

1. A blasting explosive comprising a particulate blend of from about 5 to about 27 wt. % of a slurry explosive and from about 73 to about 95 wt. % of a mixture of ammonium nitrate particles and a liquid hydrocarbon fuel based on the weight of the slurry and the ammonium nitrate/fuel mixture, the mixture of ammonium nitrate particles and a liquid hydrocarbon fuel containing from about 3.0 to about 6.0 wt. % hydrocarbon fuel based on the weight of the ammonium nitrate/fuel mixture, said particles of said blend being coated first with a gelling agent and then coated with an anticaking agent.

2. A blasting explosive as claimed in claim 1 wherein the gelling agent is a guar gum.

3. A blasting explosive as claimed in claim 1 wherein the gelling agent is a cold water hydrating guar gum.

4. A blasting explosive as claimed in claim 1, 2 or 3 wherein the gelling agent is present in an amount from about 2.5 to about 5.0 wt. % of the blend.

5. A blasting explosive as claimed in claim 1 wherein the anticaking agent is selected from the group consisting of amorphous silica, fumed silica and silicates.

6. A blasting explosive as claimed in claim 5 wherein the anticaking agent is present in an amount of from about 1.0 to about 4.0 wt. % of the blend.

7. A blasting explosive as claimed in claim 1, 2 or 5 wherein the anticaking agent is present in an amount from about 1.5 to about 3.0 wt. % of the blend.

8. A blasting explosive as claimed in claim 1, 2 or 5 wherein the ammonium nitrate particles are in the form of porous prills which have a particle size between 6 and 20 TYLER, a density of from about 1.35 g/cc to about 1.52 g/cc, a prill void volume of from about 10.0 to about 18.5% and a poured density of from about 0.7 g/cc to about 0.85 g/cc.

9. A blasting explosive as claimed in claim 1, 2 or 5 wherein the ammonium nitrate particles are prilled AN.

10. A blasting explosive as claimed in claim 1, 2 or 5 wherein the fuel is selected from the group consisting of fuel oil, heating oil, diesel fuel, jet fuel, kerosene, mineral oils, saturated fatty acids, alcohols, corn oil and soybean oil.

11. A blasting explosive as claimed in claim 1, 2 or 5 wherein the mixture of ammonium nitrate particles and a liquid hydrocarbon fuel contain from about 4.0 to about 5.0 wt. % hydrocarbon fuel based on the weight of the ammonium nitrate/fuel mixture.

12. A blasting explosive as claimed in claim 1, 2 or 5 wherein the slurry explosive contains from about 5% to about 25% water and is sensitized with a water-soluble sensitizer.

13. A blasting explosive as claimed in claim 1, 2 or 5 wherein the blend contains from about 7 to about 15 wt. % of a slurry explosive and from about 85 to about 93 wt. % of said mixture, based on the weight of said slurry and said mixture.

14. A blasting explosive comprising a particulate blend of from about 5 to about 27 wt. % of a slurry explosive and from about 73 to about 95 wt. % of the mixture of ammonium nitrate particles and a liquid hydrocarbon fuel based on the weight of the slurry and the ammonium nitrate/fuel mixture, the mixture of ammonium nitrate particles and a liquid hydrocarbon fuel contain from about 3.0 to about 6.0 wt. % hydrocarbon fuel based on the weight of the ammoniun nitrate/fuel mixture, the particles of said blend being coated first with a guar gum and then coated with a compound selected from the group consisting of amorphous silica, fumed silica and silicates.

15. A blasting explosive as claimed in claim 14 wherein the gelling agent is present in an amount from about 2.5 to about 5.0 wt. % of the blend.

16. A blasting explosive as claimed in claim 14 or 15 wherein the anticaking agent is present in an amount from about 1.0 to about 4.0 wt. % of the blend.

17. A blasting explosive as claimed in claim 14 or 15 wherein the anticaking agent is present in an amount from about 1.5 to about 3.0 wt. % of blend.

18. A blasting explosive as claimed in claim 14 wherein the ammonium nitrate particles are in the form of porous prills which have a particle size between 6 and 20 TYLER sieve size having a particle density of about 1.35 g/cc to about 1.52 g/cc, a prill void volume of about 10.0 to about 18.5% and a poured density from about 0.70 g/cc to about 0.85 g/cc and the liquid hydrocarbon fuel is selected from the group consisting of fuel oil, heating oil, diesel oil, jet fuel, kerosene, mineral oils, saturated fatty acids, alcohols, corn oil and soybean oil.

19. A blasting explosive as claimed in claim 14 or 18 wherein the blend contains from about 7 to about 15 wt. % of a slurry explosive and from about 85 to about 93 wt. % of said mixture, based on the weight of said slurry and said mixture.

20. A method of preparing a blasting explosive comprising the steps of:

(a) preparing a blend of from about 5% to about 27 wt. % of the slurry explosive and from about 73% to about 95 wt. % of a mixture of ammonium nitrate particles in a liquid hydrocarbon fuel based on the weight of the slurry and the ammonium nitrate/fuel mixture, the mixture of ammonium nitrate particles in a liquid hydrocarbon fuel containing from about 3.0 to about 6.0 wt. % hydrocarbon fuel based on the weight of the ammonium nitrate/fuel mixture;

(b) coating the particles in the blend with a gelling agent; and (c) subsequently coating the particles in the blend with an anticaking agent.

21. A method as claimed in claim 20 wherein the gelling agent is a guar gum.

22. A method as claimed in claim 20 or 21 wherein the anticaking agent is selected from the group consisting of amorphous silica, fumed silica and silicates.

23. A method as claimed in claim 20 or 21 wherein the gelling agent is present in an amount from about 2.5 to about 5.0 wt. % of the blend.

24. A method as claimed in claim 20 or 21 wherein the anticaking agent is present in an amount of from 1.0 to 4.0 wt. % of the blend.

25. A method as claimed in claim 20 or 21 wherein the ammonium nitrate is prilled AN.

26. A blasting explosive as claimed in claim 20 or 21 wherein the blend contains from about 7 to about 15 wt. % of a slurry explosive and from about 85 to about 93 wt. % of said mixture, based on the weight of said slurry and said mixture.

* * * * *